US005473226A

United States Patent [19]

Beschle et al.

[11] Patent Number: 5,473,226

[45] Date of Patent: Dec. 5, 1995

[54] INCANDESCENT LAMP HAVING HARDGLASS ENVELOPE WITH INTERNAL BARRIER LAYER

[75] Inventors: Mark D. Beschle, Merrimac, N.H.; Erich J. Bockley, N. Reading, Mass.; Peter R. Gagnon, Lexington, Ky.; Robert M. Griffin, Hamilton, Mass.

[73] Assignee: Osram Sylvania Inc., Danvers, Mass.

[21] Appl. No.: 153,736

[22] Filed: Nov. 16, 1993

[51] Int. Cl.[6] ..... H01K 1/26

[52] U.S. Cl. ..... 313/580; 313/579

[58] Field of Search ..... 313/579, 578, 313/580

[56] References Cited

U.S. PATENT DOCUMENTS

| | | | |
|---|---|---|---|
| 2,838,707 | 6/1958 | Schwing et al. | 313/489 |
| 3,205,394 | 9/1965 | Ray | 313/489 |
| 3,496,401 | 2/1970 | Dumbaugh, Jr. | 313/221 |
| 3,609,212 | 9/1971 | Lewis et al. | 174/50.62 |
| 3,798,491 | 3/1974 | Malm | 313/315 |
| 3,900,754 | 8/1975 | Mason et al. | 313/221 |
| 3,902,091 | 8/1975 | Mason et al. | 313/221 |
| 3,982,046 | 9/1976 | Mason et al. | 427/106 |
| 4,060,423 | 11/1977 | Thomas | 106/52 |
| 4,105,826 | 8/1978 | Thomas | 428/379 |
| 4,148,935 | 4/1979 | Schreurs | 427/67 |
| 4,256,988 | 3/1981 | Coaton et al. | 313/221 |
| 4,344,016 | 8/1982 | Hoffmann et al. | 313/489 |
| 4,366,409 | 12/1982 | Mieda et al. | 313/315 |
| 4,409,516 | 10/1983 | Thomas et al. | 313/579 |
| 4,441,051 | 4/1984 | Thomas | 313/579 |
| 4,463,277 | 7/1984 | DeCaro | 313/25 |
| 4,508,991 | 4/1985 | Würster et al. | 313/579 |
| 4,663,557 | 5/1987 | Martin, Jr. et al. | 313/112 |
| 4,689,519 | 8/1987 | Ooms et al. | 313/112 |
| 4,737,685 | 4/1988 | Thomas | 313/579 |
| 4,961,019 | 10/1990 | White et al. | 313/25 |
| 5,017,825 | 5/1991 | Heijnen et al. | 313/112 |
| 5,036,244 | 7/1991 | Shaffer | 313/116 |
| 5,051,653 | 9/1991 | DeBoer et al. | 313/489 |
| 5,128,589 | 7/1992 | Dakin | 313/634 |
| 5,272,408 | 12/1993 | Levin et al. | 313/113 |

FOREIGN PATENT DOCUMENTS

| | | | |
|---|---|---|---|
| 59-130062 | 7/1984 | Japan | H01J 61/30 |
| 1456242 | 11/1976 | United Kingdom | H01K 1/32 |

OTHER PUBLICATIONS

"FT-IR Diagnostics of Tungsten-Halogen Lamps: Role of Halogen Concentration, Phosphorus, Wall Material, and Burning Environment", (1991), Laurence Bigio et al. pp. 819–833.

*Primary Examiner*—Donald J. Yusko
*Assistant Examiner*—Lawrence O. Richardson
*Attorney, Agent, or Firm*—Carlo S. Bessone

[57] ABSTRACT

An incandescent lamp having an envelope of hardglass. The envelope encloses a tungsten filament and contains a fill material including an inert fill gas and a halogen additive. A coating of silicon dioxide (i.e., silica) is disposed on a substantial portion of the internal surface of the envelope. The silicon dioxide coating prevents the halogen additive from combining with alkaline ions of the hardglass envelope.

20 Claims, 3 Drawing Sheets

INCANDESCENT LAMP HAVING HARDGLASS ENVELOPE WITH INTERNAL BARRIER LAYER

CROSS-REFERENCE TO A RELATED APPLICATION

U.S. patent application Ser. No. 08/153,740, filed concurrently herewith and assigned to the same assignee of the present invention, relates to the present invention.

FIELD OF THE INVENTION

This invention relates in general to electric incandescent lamps and pertains, more particularly, to incandescent lamps operating by a tungsten-halogen cycle.

BACKGROUND OF THE INVENTION

In operation, tungsten-halogen lamps normally contain a non-reactive gas filling such as neon, nitrogen, argon, krypton or xenon or combination thereof together with iodine, bromine, chlorine or fluorine vapor which combines with the evaporated tungsten escaping from the incandescent filament. An equilibrium concentration is attained by the gaseous species within the lamp between the temperature limits defined by the incandescent filament and coldest spot in the lamp envelope. The cold spot temperature must be sufficiently high to prevent any tungsten halide from condensing, and providing that this condition is met a continuous tungsten transport cycle operates which keeps the envelope free from tungsten. The minimum envelope temperature depends upon the halogen or halogens taking part in the cycle.

Hardglasses, such as borosilicate or aluminosilicate glass, have been successfully used for the envelope in certain generally low-wattage, tungsten-halogen lamps. However, as the lamp wattage is increased or the size of the lamp envelope is decreased, the increased wall temperature causes an increase in the rate of diffusion of the alkaline ions of the hardglass (i.e., barium, strontium and calcium ions) to the inner surface of the glass where they are able to react with the halogen gas. The result is a permanent condensation of the thus reacted halogen gas on the inner walls of the lamp, which reduces the available halogen in the lamp to a level where the tungsten/halogen cycle no longer operates, causing the lamp to blacken. After the onset of blackening, the wall temperature of the blackened portion of the bulb wall will increase, causing a more rapid diffusion, and further blackening in a "runaway" type reaction. These high temperature reactions have often limited the use of hardglass in tungsten-halogen lamps where the glass will be subjected to high temperatures. "FT-IR Diagnostics of Tungsten-Halogen Lamps: Role of Halogen Concentration, Phosphorus, Wall Material, and Burning Environment", (1991), by Laurence Bigio et al, shows that for a tungsten-halogen capsule burning in a Parabolic Aluminized Reflector (PAR) lamp with a "hot spot" temperature of 600° C., the level of hydrogen bromide available in the gas phase decreases with burning time in a hardglass tungsten-halogen lamp, whereas the level of hydrogen bromide available in the gas phase remained at or above its initial levels in a quartz tungsten-halogen lamp.

It is undesirable to manufacture the lamps using excess halogen to compensate for the halogen which may react during the life of the lamp. This is because the excess halogen will react with the cooler portions of the filament and the lead wires over time, which will cause short life in lamps with long rated life, for example, greater than 150 hours.

The problem of excess activity is even more pronounced in lamps with fine wire filaments, for example, 50 watt, 120 volt filaments, since these thinner filaments have smaller cross sections and will not withstand halogen attack for very long before they fail.

In view of the limitations of using hardglass for the envelope of a tungsten-halogen incandescent lamp, the envelope of such lamps is often made from vitreous fused silica (i.e., quartz) or a high silica content glass such as one composed of ninety-six per cent silica and sold under the trademark Vycor. However, quartz and ninety-six per cent silica glass are difficult to process and require special sealing techniques to introduce the lead wires into the lamps because of their low coefficients of expansion, and thus leave something to be desired from an economic standpoint.

To prevent the reaction of the halogen constituents of the filling gas with various constituents of the lamp envelope, it is well known to use special glasses and/or a protective barrier layer.

U.S. Pat. No. 4,508,991, which issued to Würster et al on Apr. 2, 1985, teaches a halogen-cycle incandescent lamp with an envelope of a special soft glass wherein the inner surface of the bulb is depleted of alkali ions (i.e., sodium and potassium ions) to avoid a reaction between the halogen constituents of the filling gas and the alkali constituents of the lamp envelope. The vacancies thus generated in the glass lattice may be filled by replacement ions such as lithium, magnesium and calcium. In another embodiment, the soft glass envelope having its inner surface depleted of sodium and potassium ions is coated with a protective layer of a metal and/or semi-metal oxide such as silicon dioxide ($SiO_2$), titanium dioxide ($TiO_2$) or barium oxide ($B_2O_3$). According to Würster et al, reaction between the halogen constituent of the filling gas and alkali ions is avoided in prior known halogen cycle incandescent lamps because the lamp bulb was manufactured from quartz or hard glass which both contain either no or only minor proportions of alkali ions.

U.S. Pat. No. 3,496,401, which issued to Dumbaugh on Feb. 17, 1970, teaches an iodine-cycle incandescent lamp having a lamp envelope consisting essentially of an aluminosilicate glass composition containing a low level of alkali metal oxide (e.g., sodium oxide). According to the patent, no white coatings will be formed in such a hardglass envelope containing a maximum amount of 0.10% by weight of alkali and having a strain point of at least the envelope wall temperature. Upon incandescence of the lamp filament, the envelope of the iodine-containing lamp reaches an operating temperature of between 500°–700° C.

U.S. Pat. No. 4,256,988, which issued to Coaten et al on Mar. 17, 1981, teaches a fluorine-cycle incandescent lamp wherein the internal surface of the lamp envelope and optionally also the exposed surface of internal components of the lamp is coated with a continuous imperforate coating composed of a metal oxide such as aluminum oxide. The aluminum oxide coating prevents free fluorine from reacting with solid tungsten and the fluorides from reacting with the silica contained in the lamp envelope.

U.S. Pat. Nos. 3,900,754; 3,902,091 and 3,982,046 teach the use of glassy coatings of metal phosphates or arsenates as protective coatings for the internal surfaces of halogen-containing electric lamps, and describe a process for the formation of defect free coatings by deposition of a solution of compounds of the metal and phosphorus or arsenic, followed by evaporation of the solvent and baking of the resulting layer.

Although the above-described techniques may be effective to some degree, there is a need in the industry for alternative solutions.

SUMMARY OF THE INVENTION

It is, therefore, an object of the present invention to obviate the disadvantages of the prior art.

It is still another object of the invention to provide an improved incandescent lamp.

It is another object of the invention to provide an incandescent lamp which can be more easily manufactured and does not require special sealing techniques to introduce the lead wires into the lamps.

It is still another object of the invention to provide an incandescent lamp having a hardglass envelope which can effectively operate at higher wall temperatures than normal for a tungsten/halogen lamp and will be suitable for use in higher wattage and/or more compact lamp designs.

These objects are accomplished in one aspect of the invention by the provision of an incandescent lamp including a hermetically sealed envelope of hardglass composed of a predetermined quantity of alkaline ions. A fill material including an inert fill gas and a halogen additive is contained within the envelope. At least one tungsten filament is sealed in the envelope and supported by lead-in wires. A coating of silicon dioxide is disposed on a portion of the internal surface of the envelope for preventing the halogen additive from combining with the alkaline ions of the envelope.

In accordance with further teachings of the present invention, the coating of silicon dioxide is disposed on substantially the entire internal surface of the envelope. Preferably, the thickness of the silicon dioxide coating is within the range of from about 100 to 3000 Angstroms.

In accordance with further aspects of the present invention, the lamp may include an outer envelope of a molded light-transmissive glass body or a reflector (e.g., elliptical or parabolic). A base may be disposed at one end of the lamp.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
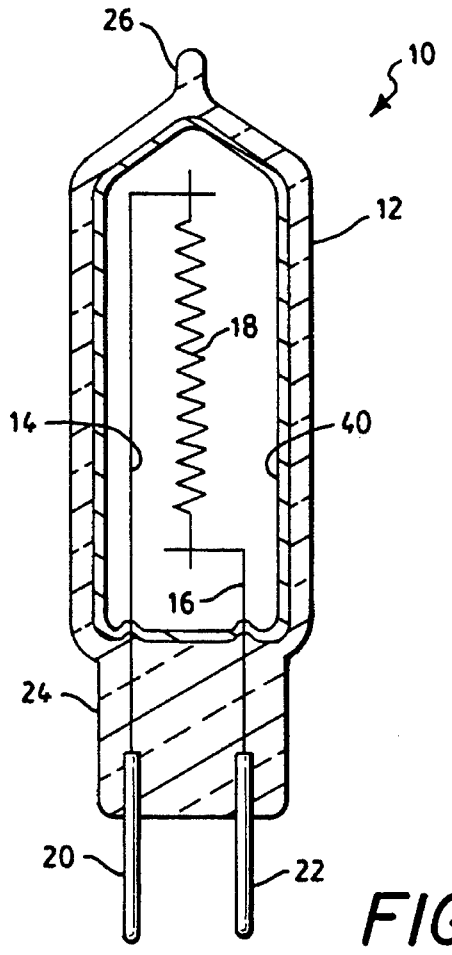
FIG. 1 illustrates a sectional view of an incandescent lamp in accordance with a preferred embodiment of the present invention.

Referring to the drawings with greater particularity, FIG. 1 shows a preferred embodiment of the present invention. In particular, FIG. 1 illustrates an incandescent lamp 10 comprising a tubular-shaped hardglass envelope 12 having a first lead-in wire 14 and a second lead-in wire 16. A tungsten filament 18 extends axially and between the internal terminations of lead-in wires 14 and 16. Filament 18 is electrically connected to a pair of contact wires or pins 20 and 22 which project from the lamp envelope. More than one filament may be contained within envelope 12. Envelope 12 is hermetically sealed, in this instance, by a press seal 24.

Envelope 12 in FIG. 1 is provided with the usual tubulation 26 (shown tipped off in the drawings) whereby air is exhausted and an inert fill gas and one or more halogens (i.e., iodine, bromine, chlorine and fluorine) is introduced. In a preferred embodiment of a low voltage lamp (e.g., 12 volts), the lamp fill comprises (by volume) 0.3% hydrogen bromide, a phosphine getter, with the balance being krypton. The total fill pressure is about 5 atmospheres absolute at room temperature. In a preferred embodiment of a 120 volt lamp, the lamp fill comprises (by volume) 0.17% hydrogen bromide, a phosphine getter, with the balance being 95%/5% krypton/nitrogen blend. The total fill pressure is about 5 atmospheres absolute at room temperature. It is to be recognized that the envelope and filament structure of the incandescent lamp of the present invention may have configurations other than that which is shown in FIG. 1.

By hardglass is meant a material having a linear coefficient of thermal expansion of from about 30 to $50\times10^{-7}$ in/in/° C. Such glasses have softening temperatures of from about 750° C. to about 1020° C. and a strain point of about 650° C. to 760° C. Exemplary of such materials are the borosilicate or aluminosilicate glasses.

One suitable glass for the present invention is GE 180 glass manufactured by General Electric Company and generally described in U.S. Pat. Nos. 4,060,423 and 4,105,826. This particular glass has the following properties:

| | |
|---|---|
| Softening point, °C. | 1020 |
| Annealing point, °C. | 805 |
| Strain point, °C. | 755 |
| Expansion (0°–300° C.) $\times 10^{-7}$ in/in/C. | 43 |

As the lamp wattage is increased or the size of the lamp envelope is decreased, the wall temperature increases causing some of the alkaline ions of the hardglass (i.e., barium, strontium and calcium ions) to diffuse to the inner surface of the glass and/or outgas into the lamp where they interact with the halogen gas. The result is a condensation of the reacted halogen gas on the inner walls of the lamp, which reduces the available halogen level in the lamp, causing the lamp to blacken. These high temperature reactions have often limited the use of hardglass in tungsten-halogen lamps where the glass will be subjected to high temperatures.

All references herein to alkaline ions refer to the common alkaline components of hardglass. In aluminosilicate and borosilicate glasses, these alkaline components may include magnesium, calcium, strontium, and barium, and mixtures thereof.

As further illustrated in FIG. 1, a barrier layer 40 is disposed on the internal surface of envelope 12 in order to limit the rate at which halogen gas combines with the alkaline ions of the hardglass at elevated temperatures.

Preferably, barrier layer 40 consists of a single thin film or coating consisting of silicon dioxide (i.e., silica). This coating forms a continuous and glassy barrier on the inner surface of the lamp envelope which prevents the alkaline ions of the hardglass from reaching the atmosphere in the lamp. As a result, the halogen (e.g., fluorine, iodine, bromine, and/or chlorine) is prevented from reacting with these components of the hardglass, which leaves the halogen in a gaseous state where it can continue the tungsten-halogen regenerative cycle.

The coating of silicon dioxide need not be free from defects such as pinholes, nor must it cover the entire internal surface of the lamp. The coating should generally cover those portions of the internal surface of the envelope which are subjected to temperatures known to be excessive for hardglass tungsten-halogen lamps. For example, for lamps in a vertical-base down burning position when the wall temperature of the upper portion of the envelope is hotter than the lower portion of the envelope, it may only be necessary to apply the barrier layer to the upper half of the envelope. The amount of surface area coated with silicon dioxide will depend upon the maximum temperature encountered as a result of the size of the envelope, the lamp wattage, and the lamp's intended burning position.

The thickness of the silicon dioxide layer should be within the range of from about 100 to 3000 Angstroms. Preferably, the layer thickness is about 1000 Angstroms.

Greater temperature resistance and longer life may be achieved when a more thorough portion of the interior of the lamp envelope is coated with the silicon dioxide layer. In FIG. 1, the entire internal surface of envelope 12 is shown coated with the silicon dioxide layer.

Silicon dioxide offers an advantage over metal oxides in that its index of refraction (1.46) more closely matches, and is lower than that of hardglass (1.54). Metal oxides typically have an index of refraction which is higher than that of silicon dioxide. For example, aluminum oxide has an index of refraction of 1.76. Metal oxide coatings with the higher refractive indexes will cause an increased amount of light to be reflected internally off of the glass surface, thus causing an effective decrease in the lamp performance. Experimental tests showed that a layer of silicon dioxide on hardglass resulted in an approximately 93% transmission of visible light through the hardglass in one pass. A layer of aluminum oxide on the hardglass resulted in only an approximately 91% transmission of visible light through the hardglass in one pass.

The silicon dioxide coating of the present invention effectively increases the upper operating temperature limit of hardglass in a tungsten-halogen lamp. More specifically, it was discovered that a long life (i.e., greater than 750 hours) tungsten-halogen lamp having an envelope formed from GE 180 hardglass without the barrier layer of the present invention had a maximum operating wall temperature of about 500° C. Above this wall temperature, the halogen gas will be depleted during the life of the lamp, eventually causing the lamp to blacken. The same glass with the internal barrier layer of silicon dioxide was found to have a maximum operating wall temperature greater than about 700° C. Due to this allowable increase in operating temperature, the hardglass envelope with the internal barrier layer of silicon dioxide can be used in higher wattage and/or more compact lamp designs.

The silicon dioxide coating can be formed on the internal surface of the lamp by many different techniques. In one embodiment, a solution is formed from a mixture of tetraethylorthosilicate, ethanol, distilled water and nitric acid. The relative amounts of the various components may be varied to yield a coating with the desired properties. The solution can then be applied to a hardglass envelope before it is pressed into a lamp by dipping methods, spraying methods, pipettes, or by drawing the solution into the envelope with a vacuum. Surprisingly, despite the mismatch in thermal expansions of the coating and the glass, it is not necessary to avoid coating the seal area of the envelope because the lamp can be sealed in with the coating in this area. After the solution is applied, it is then air dried at room temperature and fired at 450° C.–550° C. for 30 minutes in air. Alternatively, vapor deposition techniques, such as chemical vapor deposition, can be employed to produce the silicon dioxide coating. The glass envelope can then be pressed in and processed in the normal manner.

EXAMPLE 1

A solution was made using 50 ml of tetraethylorthosilicate mixed with 183 ml of ethanol, 16 ml of distilled water, and 3 ml of nitric acid. This solution was coated on the internal surface of pieces of 10 millimeter necked aluminosilicate hardglass tubing by drawing the solution up through the neck into the bulbous portion of the tubing using a vacuum. The lower portion of the tubing which forms the press was not coated with solution. The solution was then expelled back out through the neck. The coating was then air dried by blowing a light stream of air through the necked tubing, and the coating was fired at 450° C. for 30 minutes in air.

A 100 watt 120 volt coil was pressed into each bulb to which the coating of silicon dioxide had been applied to substantially the entire internal surface of the bulb, and a second group of 100 watt 120 volt coils were pressed into 10 millimeter necked tubing which did not have an internal barrier coating applied to it. Both of the lamp groups were exhausted and finished identically in the normal manner and were burned at 120 volts in clear glass outer jackets in various burning positions. The lamps were determined to have an outer wall temperature near 600° C.

Within 300 hours, a visible coating of reacted halogen products had condensed on the internal envelope walls of the lamps assembled without the internal silicon dioxide coating, and 80% of this group of lamps subsequently turned black due to evaporated tungsten condensing on the walls of the lamp because of a breakdown in the regenerative cycle.

In contrast, the group of lamps with the internal silicon dioxide coating showed no evidence of condensed halogen gas reaction products and the lamp walls remained clean and free from tungsten for over 2000 hours.

EXAMPLE 2

A test was conducted as described in example 1 except that the silicon dioxide coating covered the internal portion of the test group, including the seal area of the lamps. These lamps were pressed in with no unusual problems and finished in the normal manner. The results were identical to those described in example 1.

Figure 2:
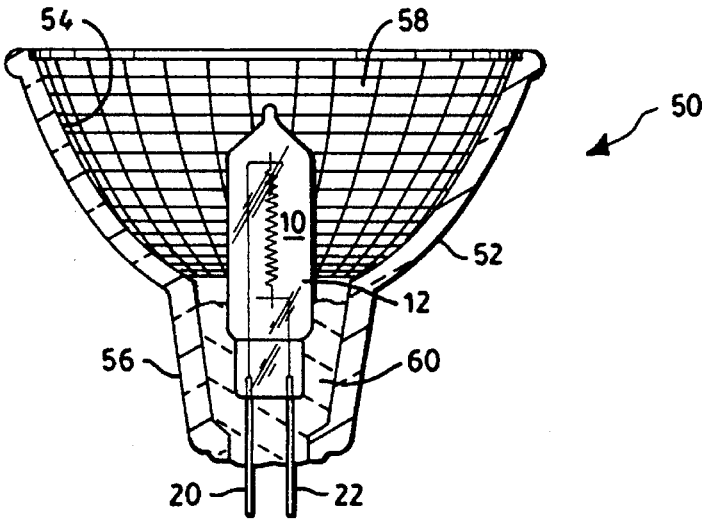
FIG. 2 shows a sectional view of an incandescent lamp having an elliptical reflector in accordance with another embodiment of the present invention.

FIG. 2 illustrates another embodiment of the present invention wherein lamp 10 of FIG. 1 is disposed within a reflector 52. Reflector 52 of combination 50 may be made of hardglass (e.g., borosilicate), and includes a forward concave reflecting portion 54 and a rear neck portion 56 adjacent thereto. Reflecting portion 54 is preferably elliptical or parabolic in configuration and has a concave reflecting surface that may be formed with a plurality of facets 58. Alternatively, the reflector may have a smooth and highly polished reflecting surface and a lens attached to the reflector. Lamp 10 may be secured to reflector 52 by means of a suitable cement 60. Contact pins 20 and 22 extend from the press seal of envelope 12 and project from rear neck portion 56 of reflector 50.

Figure 3:
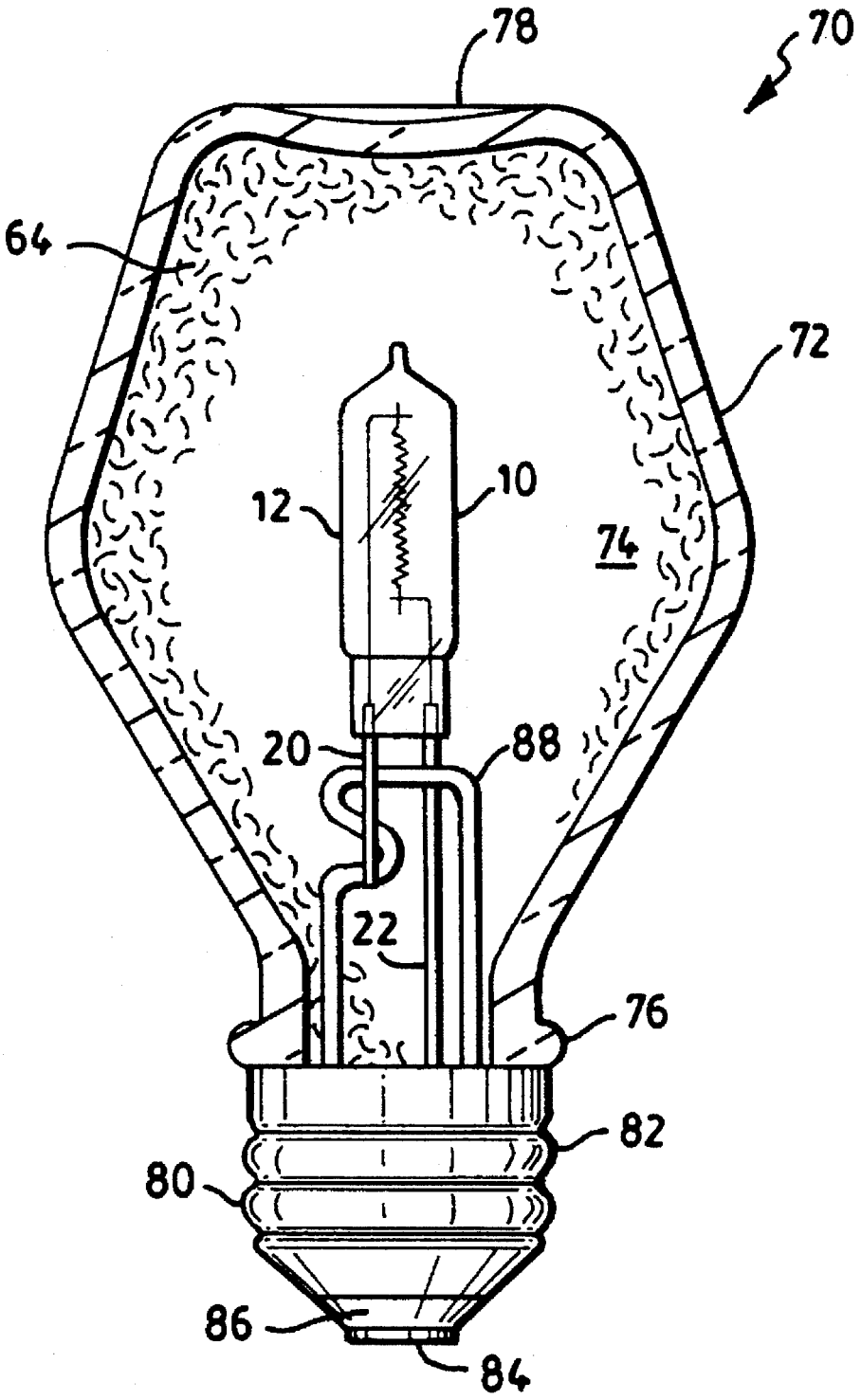
FIG. 3 shows a sectional view of an incandescent lamp having an outer envelope in accordance with another embodiment of the present invention.

FIG. 3 illustrates another embodiment of the present invention wherein lamp 10 of FIG. 1 is disposed within a light-transmissive outer glass envelope 72. Outer glass envelope 72 of combination 70 forms a cavity 74 and includes a neck portion 76 and an opposite dome portion 78. A lamp base 80 is connected to neck portion 76 of outer envelope 72. In particular, lamp base 80 includes an electrically conductive first region and an electrically conductive second region insulated therefrom. In the preferred embodiment, as depicted in FIG. 3, the electrically conductive first region includes a conventional threaded metal shell 82 and the electrically conductive second region includes a metal eyelet 84. An insulating means such as a glass insulator 86 is provided between metal shell 82 and metal eyelet 84. Contact wire 20 from lamp 10 is electrically connected to a wire support frame 88 which is electrically connected to threaded metal shell 82. Contact wire 22 from lamp 10, which is spaced from wire support frame 88, is electrically connected to metal eyelet 84.

As further illustrated in FIG. 3, the inside surface of outer glass envelope 72 may include a light-diffusing coating 64. Coating 64 may comprise a suspension of silica particles and a soluble silicate binder as disclosed in U.S. Pat. No. 5,036,244 to Shaffer.

Figure 4:
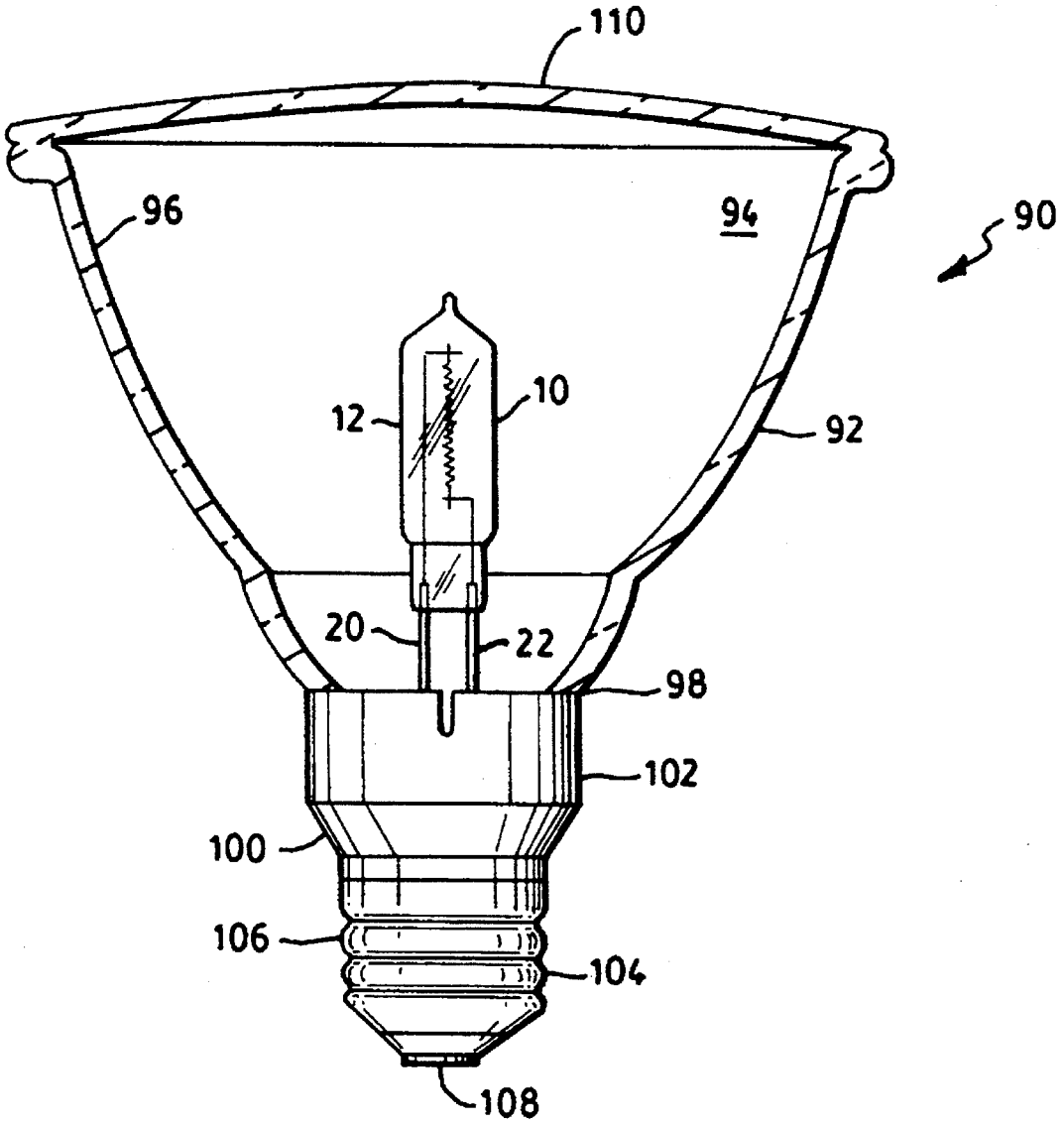
FIG. 4 shows a sectional view of a PAR incandescent lamp having a parabolic reflector in accordance with another embodiment of the present invention.

FIG. 4 illustrates another embodiment of the present invention wherein lamp 10 of FIG. 1 is disposed within a parabolic reflector 92. Reflector 92 of combination 90 may be made of hardglass (e.g., borosilicate). The reflector forms a cavity 94 and includes a forward concave reflecting portion 96 and a rear neck portion 98 adjacent thereto. An upper skirted portion 102 of a lamp base 100 is secured to neck portion 98 of reflector 92. A lower lamp base portion 104 includes a threaded metal shell 106 and a metal eyelet 108. Contact wires 20 and 22 from lamp 10 are electrically connected to threaded metal shell 106 and metal eyelet 108, respectively. A lens or cover 110 is attached or hermetically sealed in a conventional manner to the opposite end of reflector 92.

Although the above described drawings illustrate single-ended incandescent lamps, it is to be recognized that the silicon dioxide coating can alternatively be applied to the internal surface of an envelope of a double-ended incandescent lamp.

There has thus been shown and described an improved incandescent lamp. The hardglass lamp of the present invention can be more easily manufactured than a quartz lamp and does not require special sealing techniques to hermetically seal the lead wires into the lamps. The envelope can effectively operate at higher wall temperatures than normal and will be suitable for use in higher wattage and/or more compact lamp designs.

While there have been shown and described what are at present considered to be the preferred embodiments of the invention, it will be apparent to those skilled in the art that various changes and modifications can be made herein without departing from the scope of the invention. The actual scope of the invention is intended to be defined in the following claims when viewed in their proper perspective based on the prior art.

What is claimed is:

1. An incandescent lamp comprising:

a hermetically sealed envelope of hardglass composed of a predetermined quantity of alkaline ions;

a fill material including an inert fill gas and a halogen additive contained within said envelope;

at least one tungsten filament sealed in said envelope and supported by lead-in wires; and a coating of silicon dioxide disposed on a portion of the internal surface of said envelope for preventing said halogen additive from combining with said alkaline ions of said envelope.

2. The incandescent lamp of claim 1 wherein said coating of silicon dioxide is disposed on substantially the entire internal surface of said envelope.

3. The incandescent lamp of claim 1 wherein the thickness of the silicon dioxide coating is within the range of from about 100 to 3000 Angstroms.

4. The incandescent lamp of claim 3 wherein the thickness of the silicon dioxide coating is about 1000 Angstroms.

5. The incandescent lamp of claim 1 wherein said envelope is borosilicate glass.

6. The incandescent lamp of claim 1 wherein said envelope is aluminosilicate glass.

7. An incandescent lamp comprising:

an outer envelope including a molded light-transmissive glass body enclosing a cavity, a hermetically sealed inner envelope of hardglass disposed within said cavity and composed of a predetermined quantity of alkaline ions;

at least one tungsten filament sealed in said inner envelope;

a fill material including an inert fill gas and a halogen additive contained within said inner envelope;

a coating of silicon dioxide disposed on a portion of the internal surface of said inner envelope for preventing said halogen additive from combining with said alkaline ions of said inner envelope, a base disposed at one end of said outer envelope; and means for electrically connecting said tungsten filament to said base.

8. The incandescent lamp of claim 7 wherein said coating of silicon dioxide is disposed on substantially the entire internal surface of said inner envelope.

9. The incandescent lamp of claim 7 wherein the thickness of the silicon dioxide coating is within the range of from about 100 to 3000 Angstroms.

10. The incandescent lamp of claim 9 wherein the thickness of the silicon dioxide coating is about 1000 Angstroms.

11. The incandescent lamp of claim 7 wherein said envelope is borosilicate glass.

12. The incandescent lamp of claim 7 wherein said envelope is aluminosilicate glass.

13. An incandescent lamp comprising:

a reflector defining a cavity a hermetically sealed envelope of hardglass disposed within said cavity of said reflector, said envelope composed of a predetermined quantity of alkaline ions;

a fill material including an inert fill gas and a halogen additive contained within said envelope;

at least one tungsten filament sealed in said envelope; and a coating of silicon dioxide disposed on a portion of the internal surface of said envelope for preventing said halogen additive from combining with said alkaline ions of said envelope.

14. The incandescent lamp of claim 13 wherein said coating of silicon dioxide is disposed on substantially the entire internal surface of said envelope.

15. The incandescent lamp of claim 13 wherein the thickness of the silicon dioxide coating is within the range of from about 100 to 3000 Angstroms.

16. The incandescent lamp of claim 15 wherein the thickness of the silicon dioxide coating is about 1000 Angstroms.

17. The incandescent lamp of claim 13 wherein said envelope is borosilicate glass.

18. The incandescent lamp of claim 13 wherein said envelope is aluminosilicate glass.

19. The incandescent lamp of claim 13 further including a base disposed at one end of said reflector and means for electrically connecting said tungsten filament to said base.

20. A lamp envelope for containing a halogen additive, said lamp envelope comprising:

hardglass having an internal surface and composed of a predetermined amount of alkaline ions; and a coating of silicon dioxide disposed on a portion of said internal surface of hardglass for preventing the halogen additive from combining with the alkaline ions of the envelope.

* * * * *